US007954819B2

(12) United States Patent
Lokos

(10) Patent No.: US 7,954,819 B2
(45) Date of Patent: Jun. 7, 2011

(54) PINBALL MACHINE

(75) Inventor: Ronald Lokos, Sparta, NJ (US)

(73) Assignee: Moose Mountain Toymakers Ltd., Hong Kong (CN)

( * ) Notice: Subject to any disclaimer, the term of this patent is extended or adjusted under 35 U.S.C. 154(b) by 717 days.

(21) Appl. No.: 11/638,684

(22) Filed: Dec. 13, 2006

(65) Prior Publication Data

US 2008/0143047 A1 Jun. 19, 2008

(51) Int. Cl.
*A63F 7/02* (2006.01)

(52) U.S. Cl. ..... 273/119 R; 273/109; 273/118 A; 273/118 R; 273/119 A; 273/121 A; 273/121 R

(58) Field of Classification Search ..... 273/109, 273/118 A, 118 R, 119 A, 119 R, 121 A, 273/121 R See application file for complete search history.

(56) References Cited

U.S. PATENT DOCUMENTS 2,048,944 A * 7/1936 Munro et al. ..... 273/108.53
3,452,987 A * 7/1969 Di Motta ..... 273/110
3,582,074 A * 6/1971 Menotti ..... 273/121 A
3,643,954 A * 2/1972 Meyer et al. ..... 273/119 A
3,675,927 A * 7/1972 Gottlieb et al. ..... 273/119 A
4,176,844 A * 12/1979 Ryan et al. ..... 273/121 A
4,230,317 A * 10/1980 Breslow et al. ..... 273/119 A
4,323,241 A * 4/1982 Deutsch ..... 273/121 A
4,354,680 A * 10/1982 Kmiec ..... 273/121 A
4,367,876 A * 1/1983 Kotoyori ..... 273/121 A
4,375,286 A * 3/1983 Seitz et al. ..... 273/121 A
4,380,335 A * 4/1983 Chaudhry et al. ..... 273/121 A
4,448,417 A * 5/1984 Clark et al. ..... 273/121 A
4,606,545 A * 8/1986 Ritchie ..... 273/121 A
4,650,190 A * 3/1987 Geiger ..... 273/121 A
4,840,375 A * 6/1989 Lawlor et al. ..... 273/121 A
4,986,543 A * 1/1991 Heller ..... 273/121 A
4,991,845 A * 2/1991 Wies ..... 273/121 A
5,064,196 A * 11/1991 Gottlieb ..... 273/121 A
5,131,654 A * 7/1992 Gottlieb et al. ..... 273/121 A
5,238,248 A * 8/1993 Gottlieb ..... 273/121 A
5,284,342 A * 2/1994 Tanzer et al. ..... 273/121 A
5,324,034 A * 6/1994 Gottlieb ..... 273/121 R
5,330,183 A * 7/1994 Gottlieb ..... 273/121 R
5,368,299 A * 11/1994 Driska ..... 273/119 R
5,368,300 A * 11/1994 Becker ..... 273/121 R
5,415,401 A * 5/1995 Nagasaka ..... 273/110
5,494,285 A * 2/1996 Coldebella et al. ..... 273/118 R
5,536,082 A * 7/1996 Ritchie et al. ..... 312/322
5,707,059 A * 1/1998 Sullivan et al. ..... 273/121 A
5,730,441 A * 3/1998 Gibbons et al. ..... 273/118 D
5,788,231 A * 8/1998 To ..... 273/126 R
5,806,851 A * 9/1998 Gomez et al. ..... 273/121 A
5,884,911 A * 3/1999 Guridi ..... 273/119 R
5,890,715 A * 4/1999 Gomez et al. ..... 273/118 A (Continued)

*Primary Examiner* — Gene Kim
*Assistant Examiner* — Alexander R Niconovich
(74) *Attorney, Agent, or Firm* — Lerner, David, Littenberg, Krumholz & Mentlik, LLP

(57) ABSTRACT

A pinball adapted for play by either one or two players. The pinball game includes the playing surface having first and second ends. The playing surface is adapted for supporting a pinball between the ends. The pinball game also includes a tilting assembly associated with the playing surface for orientating the playing surface between a substantially horizontal position and an inclined position directed towards one of the first and second ends. When the pinball game is adapted to be played by one player, the playing surface is in the inclined position. But when the pinball game is adapted to be played by two players, the playing surface is in the horizontal position.

12 Claims, 6 Drawing Sheets

U.S. PATENT DOCUMENTS 5,961,116 A * 10/1999 Beyer ..... 273/119 R
6,000,697 A * 12/1999 Popadiuk et al. ..... 273/118 R
6,113,097 A * 9/2000 Krutsch et al. ..... 273/118 A
6,311,975 B1 * 11/2001 Motosko ..... 273/121 A
6,402,140 B1 * 6/2002 Wood ..... 273/108.1
6,450,497 B1 * 9/2002 Bialler et al. ..... 273/108.1
6,457,710 B1 * 10/2002 Bisbee et al. ..... 273/108.1
6,598,876 B1 * 7/2003 Pierce et al. ..... 273/118 R
7,220,185 B2 * 5/2007 Chen ..... 473/4
7,389,987 B1 * 6/2008 Paukert ..... 273/108.1
2005/0253330 A1 * 11/2005 Navarro ..... 273/108.5
2006/0103069 A1 * 5/2006 Hansen ..... 273/109
2009/0085286 A1 * 4/2009 Grist et al. ..... 273/121 D

* cited by examiner

PINBALL MACHINE

BACKGROUND OF THE INVENTION

The present invention relates generally to a rolling ball game such as a pinball game, and more particularly to a pinball game having two different scoring mechanisms.

For years, pinball machines or games have provided a source of leisure time enjoyment for a variety of people. Despite the recent proliferation of computerized video arcades, pinball continues to be recognized as a popular pastime. Pinball games offer the player the ability to manipulate an actual physical object as opposed to a character on the screen.

When playing pinball, the player usually sets the ball into play with a spring biased arm or plunger. As the ball strikes various scoring elements, such as post bumpers and slingshot bumpers, the player earns points according to the number of times the ball strikes the bumper and the point value of each bumper. The player has no control over the movement or placement of these scoring elements as once as he sets the ball in motion, the ball randomly strikes various bumpers and other scoring elements.

Because the ball rolling or playing surface of the pinball tables is gently sloped, the force of gravity constantly urges the ball toward the base of the table. Usually mounted in the base of the table are two flippers that may be electro-mechanically actuated by a player by depressing buttons located on a side of a machine's cabinet. By correctly timing the actuation of the flippers, the player can use the flippers to strike the ball and propel it into the playing area to again contact the various scoring elements in order to score further points.

In contrast to the bumpers or other scoring elements, movement of the flippers is within the control of the player. These flippers do not detect the ball contact like the bumpers and other scoring elements, and no points are scored as a result of contact between the flipper and the ball. The flippers are merely ball-propelling devices. The primary purpose of the flipper is to keep the ball in play and prevent it from escaping the playing field by passing through the space located between or around the flippers thereby adding to the play of that particular ball.

As developed over the years, pinball is primarily an individual activity. One player controls both flippers and the score is tabulated on a per ball basis. Although it is possible in tables that employ independently actuated flippers for a first player to control the actuation of one flipper and a second player to control the actuation of a second flipper, a single score is tabulated preventing the players from distinguishing themselves on the basis of score.

Most pinball machines allow two players to compete with one another by allowing the first player to play one ball and retain that player's score on a visible scoring board. The second player then plays a ball, which is scored separately. Thus, at the conclusion of the second player's game, the two players can compare scores to see who scored the greater number of points and thereby determine the winner.

The primary problem with competitive pinball played on a machine as described above is that only one player can play at a time. There is always one player who is not involved in the activity of the game. If one player has a particularly long round, the resting player may become bored and lose interest in the game.

In contrast, the game of air hockey has allowed for two players to play simultaneously while trying to score on one another. The game of air hockey has been known and widely played for many years. Typically, this game requires an air hockey table including a large, elongated substantially planar playing surface. Indeed, the conventional, full-size table is quite large and requires a great degree of space.

The existing air hockey assemblies as the type described above, have generally incorporated a free-standing table or platform on which the playing surface is built. The air hockey table or platform comprise a large, flat, perforated surface that forms the above-mentioned playing surface as well as what may be considered a top of a pressurized air chamber or plenum.

Air hockey scoring is limited to being awarded a single point when a player is able to get the air hockey puck in the opposing player's goal. Therefore, although air hockey provides the ability for two players to play simultaneously and against one another, it is limited in its scoring and point awarding system.

Therefore, what is needed is a pinball game that not only provides the benefits of a one-player conventional pinball game but also a pinball game that also provides the benefits of a simultaneously two-player competition game with multiple scoring.

SUMMARY OF THE INVENTION

The present invention is directed to a pinball game, more particularly a pinball game that includes features that allow the game to be played by one player or two opposing players. The pinball game may be played in an inclined position, for instance, by one player or in a substantially horizontal position, for instance, by two opposing players.

When the game is being played by two opposing players, points may be awarded to only one player during a single game turn. In such a configuration, points are constantly tallied as a ball, disposed on the playing surface, contacts various point awarding mechanisms such as bumpers and the like. As the points are being tallied, the two opposing players try to score the ball into an opposing player's goal. If one player should score a goal on the other player, that player is awarded all the points that have been tallied. Of course, other scoring configurations may be used as well.

When the game is positioned to be played by one player, various mechanisms such as extension legs and the like may be used to enable the playing surface of the pinball game to become slanted such that the ball is biased in a direction toward the player. In this configuration, the pinball game may be played as a conventional pinball game, thereby awarding points to a player as various point-awarding mechanisms are contacted.

By providing a pinball game that can play by two players or one player, the present invention has the advantages of satisfying a need on the market.

DETAILED DESCRIPTION

Figure 1:
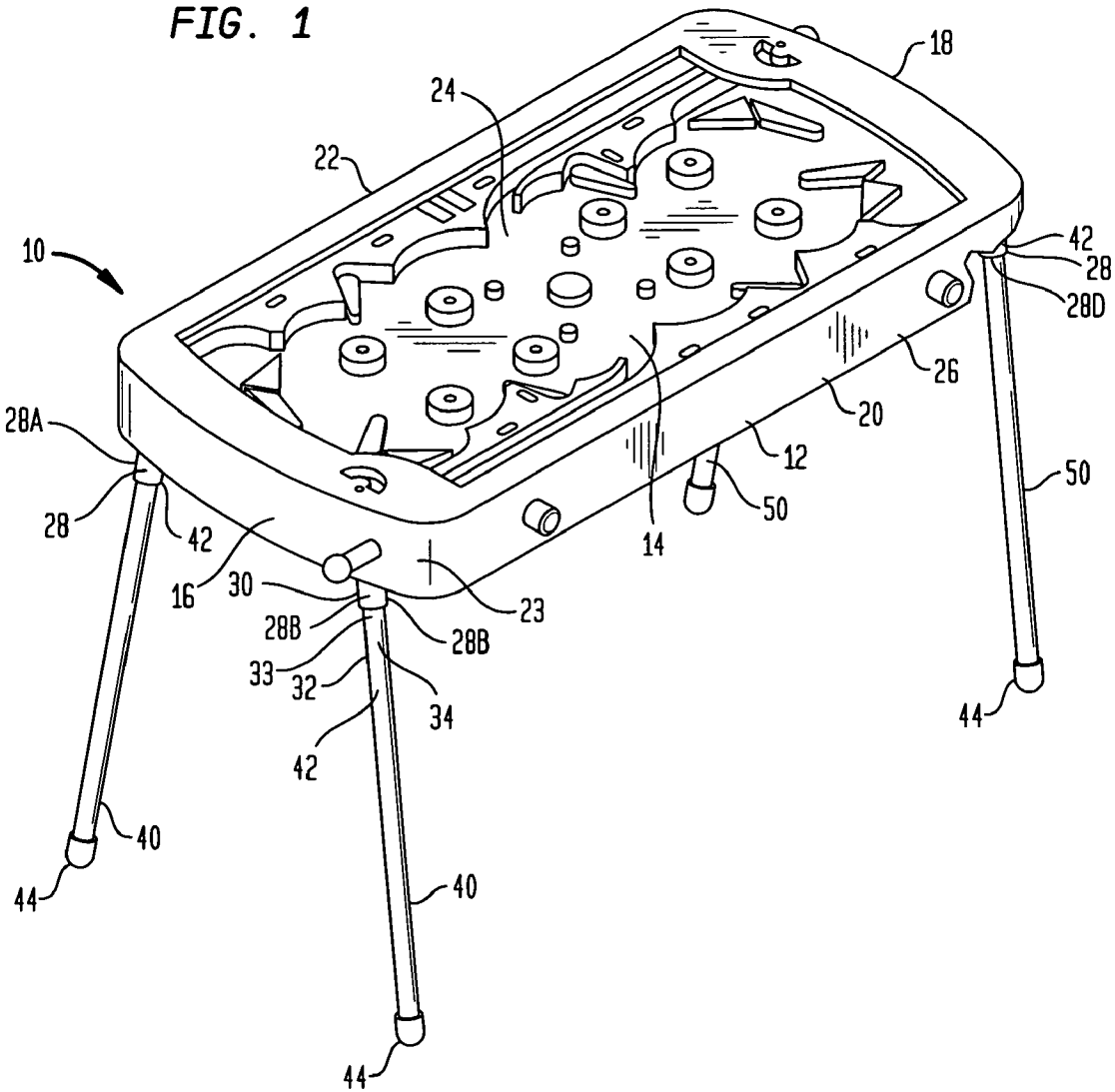
FIG. 1 is a perspective of one embodiment of the present invention.

With reference to FIG. 1, there is disclosed a pinball machine 10 according to one embodiment of the present invention. The pinball machine includes a box-like frame 12 with a bottom panel 14 and a plurality of side walls. The side walls include a first frame member 16 and a second opposing frame member 18. The first frame member 16 and second frame member 18 are positioned on opposite ends of the bottom panel 14. Each of the frame members 16, 18 extend upwardly from the bottom panel 14 so as to define a boundary of the box-like frame 12. The side walls also include a third frame member 20 and a fourth frame member 22, which is positioned on the opposite side of the bottom panel 14 as compared to the third frame member. Similar to the first frame member and second frame member 16, 18, the third frame member and fourth frame member 20, 22 extend upwardly from the bottom panel 14 and help to define a playing boundary for the pinball machine as will be discussed below.

The first frame member 16 is attached at both of its ends to respective ends of the third and fourth frame members 20, 22 such that the first frame member is substantially perpendicular to the third and fourth frame member. Similarly, the second frame member 18 is positioned adjacent to opposing ends of the third frame member 20 and fourth frame member 22 and is also substantially perpendicular to these frame members. As shown in the figure, a curved wall 23 may be positioned between adjacent end walls of each of the frame members such that a smooth transition is achieved between the substantially perpendicular frame members.

The bottom panel 14 preferably includes a playing surface 24 and oppositely-facing rear surface 26. The playing surface 24 sets the stage of how the pinball game is played. A further discussion regarding this feature will follow. The rear surface 26 faces downwardly. Extending downwardly from the rear surface 26 of the bottom panel 14 is a plurality of coupling elements 28. The coupling elements 28 may be formed in conjunction with the rear surface 26 such as during a molding, extruding or shaping process. In an alternate embodiment, the coupling elements 28 may be attached to the rear surface 26 of the pinball machine 10 using various attaching mechanisms such as rivets, screws and the like. In either case, each coupling element 28 of which there are preferably four, includes an exterior wall 30 and an interior wall 32. The interior wall 32 defines a cavity 34 that is preferably cylindrical. The exterior wall 30 and interior wall 32 are attached to one another by a circumferential edge 33. Although the coupling elements 28 are shown as protrusions extending outwardly from the rear surface 26, in alternate embodiments, the coupling elements 28 may be recesses disposed within the rear surface 26.

The pinball machine 10 further includes a first set of legs 40, each having a first end 42 and a second end 44. Each of the legs in the first set of legs 40 is preferably cylindrical and has a diameter, at least at their respective first end 42 that is substantially equal to the diameter of the cavity 34 of the coupling elements 28. In a method of assembly, the first legs 40 may be received within coupling elements 28A and 28B, which are proximate the first frame member 16 of the pinball machine 10 and remote from the second frame member 18. The first ends 42 of the legs 40 may be received within the cavity 34. Preferably a securing mechanism such as a snap fit or compression fit as well as other methods known to those in the art interlocks the legs 40 within the cavities 34. For instance, each of the cavities 34 may have an internal thread that can threadly engage external threads disposed on the first end 42 of the legs thereby allowing the legs to be screwed into the coupling elements 28 such that they are secured therewith.

Figure 2:
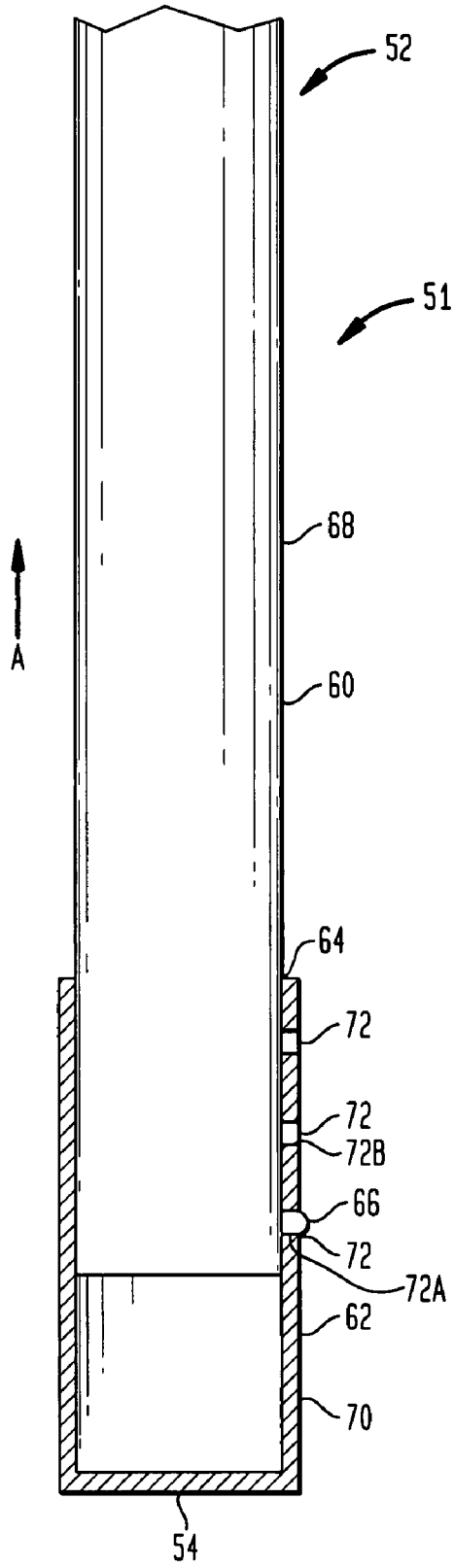
FIG. 2 is a cross-sectional view of one leg used in conjunction with the pinball game of the present invention.
Figure 3:
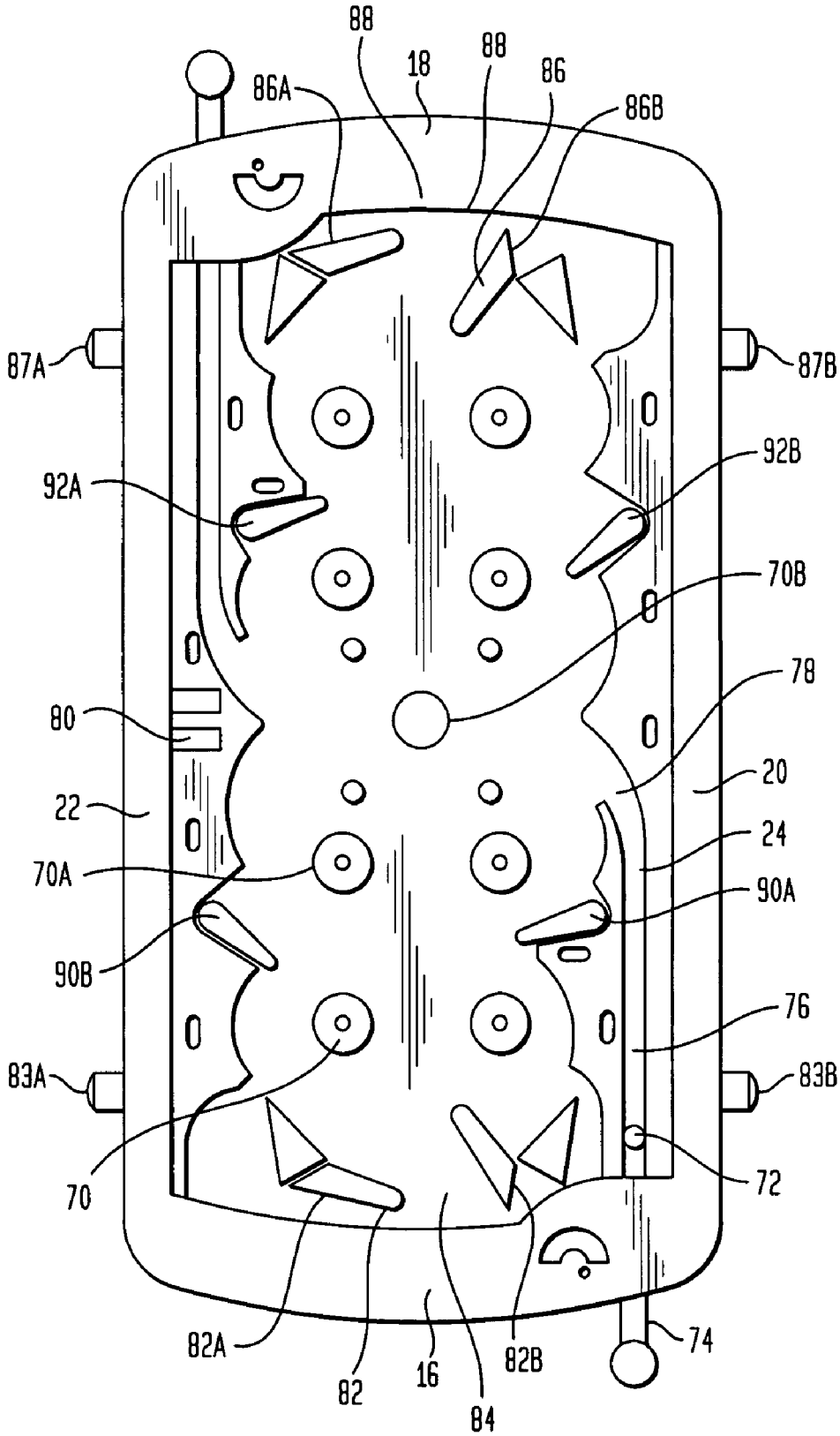
FIG. 3 is a top view of the embodiment shown in FIG. 1.

The pinball machine 10 further includes a second set of legs 50, each of which also include first ends 52 and second ends 54, shown in FIG. 2. The second set of legs 50 are received within the cavities 34 of coupling elements 28C (not shown in FIG. 1) and 28D respectively and similar to the first set of legs 40, the second set of legs 50 may include various mechanisms and/or features that enable the first ends 52 of the second set of legs to be tightly secured within a cavity 34 of the coupling elements 28C and 28D. An example of one of the second set of legs 50 is illustrated in FIG. 2.

As shown in FIG. 2, the leg 51 which is one of the second set of legs 50 includes a first extension 60 and a second extension 62. The first extension 60 is received within an opening 64 of the second extension 62 such that the two extensions may be telescopically connected. The first extension 60 includes a protrusion 66 extending outwardly from an exterior surface 68 of the first extension. The protrusion may include the ability to be recessed within the exterior surface 68 of the first extension 60 by including various springs and features that enable such a structure. In contrast, the exterior surface 70 of the second protrusion 62 includes a plurality of apertures 72 extending along the exterior surface 70 of the second extension 62. The plurality of apertures 72 are preferably aligned along a common longitudinal axis, although this is not required.

As illustrated in the figure, in one arrangement, the protrusion 66 of the first extension 60 extends outwardly through aperture 72A of the second extension thereby locking first extension 60 to the second extension 62. This enables leg 50A to have a first height h that is equal to height of the first set of legs 40. In order to extend the length of the second set of legs 50, the protrusion may be moved inward towards the exterior surface 68 of the leg 50A thereby allowing the first extension 60 to be moved upward in a direction illustrated by arrow A. The protrusion may then be allowed to extend through aperture 72B. This increases the overall height of the leg 50A to a height H, which is greater than the height h. A further discussion regarding this feature is described below.

Once the pinball machine 10 is assembled with the various legs attached to the coupling elements, the playing surface 24 is substantially planar and horizontal so long as the sets of legs 40 and 50 have a common height.

Various features of the game will now be described with the assumption that all the legs are at a first height, which is common throughout. In this example, the sets of legs 40, 50 all extend the same length. In this orientation, the game is specifically adapted to be played by two opposing players. The term "opposing" players refers to the ability of the players to score against each other as opposed to each player trying to achieve his own high score and then comparing that score to the other opposing player.

The playing surface 24 includes a plurality of ball-engaging mechanisms 70 mounted to the surface. The ball-engaging mechanisms 70 may include a variety of elements such as posts, bumpers and sling-shot bumpers, as well as other similar ball-engaging mechanisms that are well known in the art. The ball-engaging mechanisms 70 may be constructed as discussed in U.S. Pat. Nos. 5,730,441; 5,707,059; 6,000,697 and 6,113,097, the disclosures of which are hereby incorporated by reference herein. In either case, the ball-engaging mechanisms 70 have a point value assigned to them such when they are struck with a ball 72 during the play of the game, a score is accrued. Additional ball-engaging mechanisms 70 of the game may include an element that propels the ball away from the specific ball-engaging mechanisms when contacted by the ball, such as leaf or trigger switches well known in the art.

The pinball machine 10 further includes a first plunger 74, which is biased with a spring (not shown) and used to propel a ball 70 onto the playing surface 24 for play. As for instance, a first player may stand at the end of the machine adjacent the first frame member 16 where the first plunger 74 is located. The first player may draw back on the plunger 74 and then let go. The plunger 74 contacts the ball 72 and exerts a force outwardly thereby propelling the ball through runway 76 until the ball 72 is projected outwardly through gate 78 disposed at the end of the runway 76. The gate 78 is biased such that once the ball propels outwardly from the runway 76, the gate swings back thereby closing one end of the runway. Once the ball 72 exits the gate 78, it may contact the ball-engaging mechanisms 70 thereby accruing a point value each time it contacts one of the mechanisms. This point value is constantly updated, tallied and reflected at display 80. Display 80 may be an LCD scoring system or various other counters known to those in the art.

Figure 4:
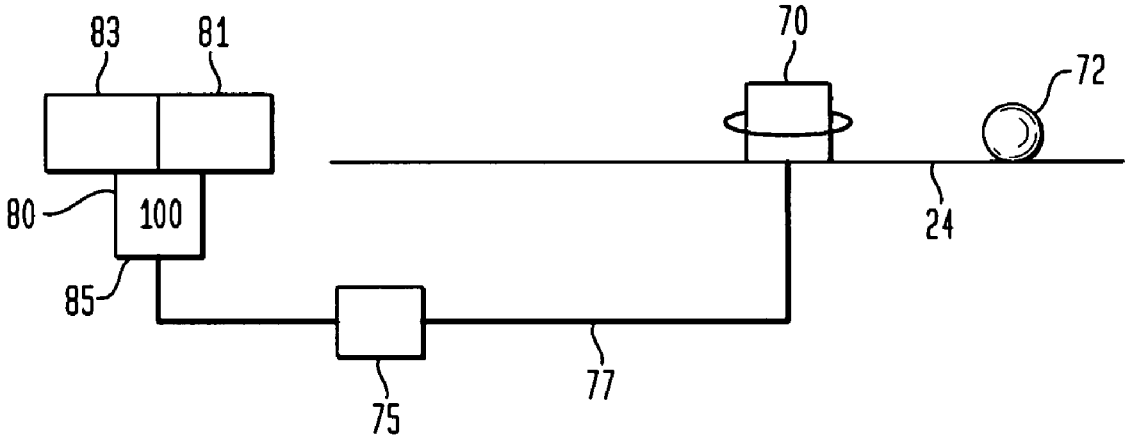
FIG. 4 is a schematic view of a point system according to an embodiment of the present invention.

A general outline of a scoring system known to those in the art is shown in FIG. 4. For instance, ball-engaging mechanism 70 is positioned on playing surface 24. When ball 72 comes into contact with ball-engaging mechanism 70, a signal is sent by the ball-engaging mechanism to a processing center 75. The signal may be sent via a pathway 77 which may include mechanical actuation members, electrical elements and combinations of the same. As the signals are sent by the ball-engaging mechanism 70, the processing center 75 computes the individual points awarded and also keeps track of a tallied total. Various software known to those in the art may be included within the processing center 75 so as to keep track of the points as the scores continue to tally. The processing center may then send a signal to display 80 such that the players are aware of the total number of points being accrued.

Although a first player starts of the game, propelling the ball 72 through runway 76, a second player is positioned adjacent to second frame member 18. As the points are being tallied, neither the first player nor second player has yet accrued any of these points.

During the game, the first player has the ability to control a first set of flippers 82 by compressing actuation buttons 83 disposed on the side walls of the box-like structure 14. Actuation of buttons 83 causes flippers 82 to pivot about an axis such that the front end of the flippers propel forward. Button 83A controls flipper 82A while button 83B controls flipper 82B. The flippers 82A and 82B are separated by a distance thereby enabling a ball to pass between the two flippers and into a goal area 84.

Similarly, the second player has control over a second set of flippers 86 by the use of actuation buttons 87A and 87B. As before, button 87A controls movement of flipper 86A while button 87B controls movement of flipper 86B. The two flippers are separated by a distance at their respective front ends such that a ball may fit between the two flippers and into a second goal area 88.

Therefore, in a two-player orientation, the ball 72 may come in come in contact with ball-engaging mechanisms 70 including various bumpers 70A and a spinning trap 70B as well as additional ball-engaging mechanisms known to those in the art. Each time the ball engages one of the ball-engaging mechanisms 70, a point or a plurality of points may be tallied. In order to be awarded the tallied points, a player must score a goal on the opposite player by getting the ball 72 between the players opposing flippers 72 or 82 and into the goal area 84 or 88. For instance, if the ball should happen to go into goal 88 adjacent to the second player, all the points that were previously tallied during the sequence would go to the first player. A second ball may now be introduced into the playing surface and begin the process again. As such, a single ball being introduced onto the playing surface 24 and exited the playing surface by exiting through one of the goal areas 84 or 88 constitutes a single round. Once one player wins the points tallied, the points on the display 80 are awarded to the player and displayed at a different location on display 80 such as first player display 81 on display 80 in FIG. 4. The second player display 83 illustrates the score of the second player and tally display 85 illustrates the score tallied before it is awarded to one of the players.

In order to create a faster game meaning that the ball travels quicker, an additional set of flippers 90A and 90B may also be controlled by the buttons 83A and 83B by the first player. This additional set of flippers is closer to the center of the playing surface 24 and thereby allows the first player to have more input on the ball projection throughout the playing surface 24. Similarly, the second player may have an additional set of flippers 92A and 92B, which are also controlled by the buttons 87A and 87B by the second player. It is important to remember that the two-player game is played with all of the legs being equal in height such that the playing surface is substantially horizontal.

Figure 5:
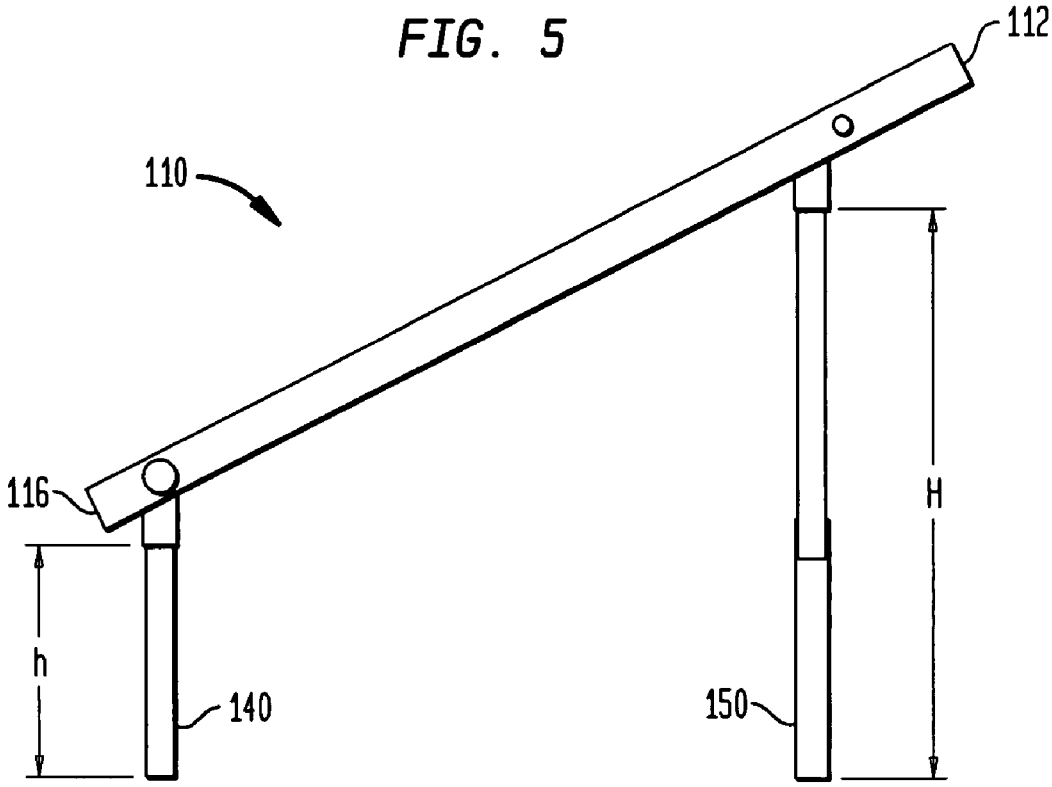
FIG. 5 is a cross-section view of a pinball game of FIG. 1 in a different arrangement.
Figure 6:
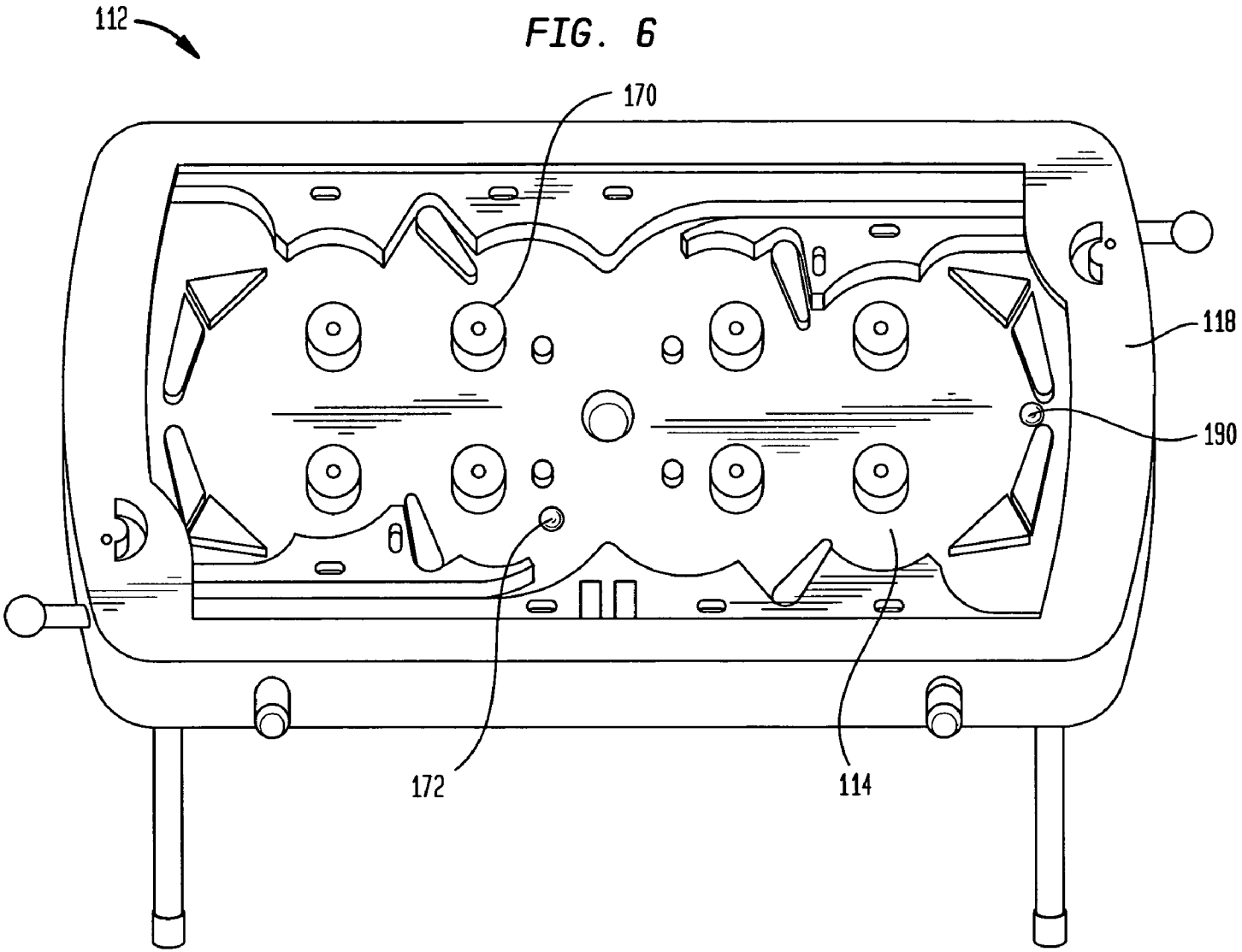
FIG. 6 is a top view of the pinball game arrangement of FIG. 5.

In an alternate embodiment, the second set of the legs 50 may be extended such that they are at a height H thereby creating a slanted playing surface 124 such that a ball 172 is urged toward the first player by gravity, for instance, as shown in FIG. 5, a second set of legs 150 has a height H which is greater than the height of the first set of legs 140 thereby giving the box-like construction 112 a slanted axis angled toward a first frame member 116. Like features are discussed using like character references as compared to the first embodiment of the present invention unless specifically articulated. In this orientation, a single player may play the pinball machine 110 similar to a conventional pinball game. In order to aid in this one-player game, as shown in FIG. 6, a plurality of stopping gates 190 may be positioned within the various open spaces that are adjacent the second frame member 118, where the second player would stand in a two-player game. The stopping gates 190 prohibit the ball 170 from exiting into a goal on the second player side as well as other runways and exit avenues. The stopping gates 190 may be recessed within the bottom surface 114 of the pinball machine 112 and actuated upwards using various levers and the like.

In such an orientation, a single player may switch the score system to a one-player mode such that all the points accrued by the ball 172 contacting the ball-engaging mechanisms 170 are immediately accrued to the single player and continue to tally as the ball engages various different mechanisms.

The second set of legs 150 may be extended at different lengths thereby increasing the angle of the playing surface 124. As the angle increases, the pinball game becomes faster as gravity has more influence on the ball 172, pulling the ball towards the flippers of the first player.

Figure 7:
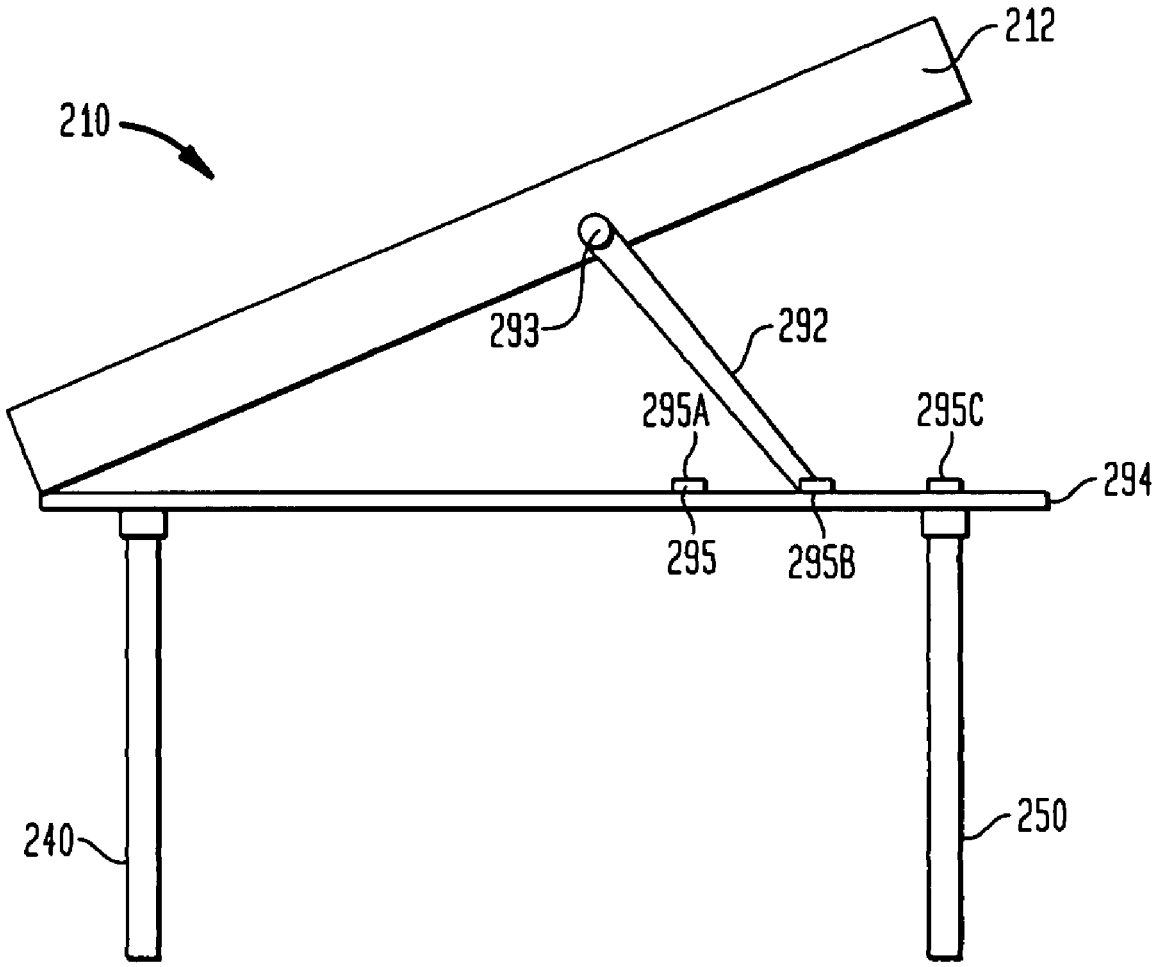
FIG. 7 is a cross-sectional view of an alternate embodiment of the present invention.

In an alternate embodiment, as shown in FIG. 7, the pinball machine 210 may have a first set of legs 240 and a second set of 250 that are substantially identical, and have a common height. Therefore, in order to slant the box-like frame 112, a pivoting element 192 may be provided. The pivoting element is attached to a portion of the box-like frame 212 and may pivot along a joint 293. The pinball machine 210 also includes a support surface 294 disposed proximate first ends of the various legs. The support surface 294 includes a plurality of positioning elements 295, which may be engaged by the pivoting element 292. The pivoting element 292 is positioned proximate one of the positioning elements 295A, as shown in the figure, such that the box-like frame 212 may be tilted at a specific angle. Pivoting element 292 may be engaged with additional positioning elements 295A or 295C resulting in a different angle at which the box-like frame 212 is positioned.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A pinball game comprising:

a playing surface for playing pinball by one-player and two-players;

a first goal area associated with said playing surface;

a second goal area associated with said playing surface;

a pair of spaced apart first flippers positioned on said playing surface in front of said first goal area, said first flippers providing an opening therebetween to allow access to said first goal area by a ball disposed on said playing surface;

a pair of spaced apart second flippers positioned on said playing surface in front of said second goal area, said second flippers providing an opening therebetween to allow access to said second goal area by a ball disposed on said playing surface;

a pair of legs for supporting said playing surface of the pinball game, said pair of legs having a first predetermined height and a second predetermined height, such that when said pair of legs is positioned at said first predetermined height the pinball game playing surface is horizontally oriented enabling play by two players, and when said pair of legs is positioned at said second predetermined height, the pinball game playing surface is oriented at an incline enabling play by one player; and at least one barrier arrangeable into a first position extending upwardly from said playing surface for blocking only said opening between said second flippers to prevent access to said second goal area, such that when the pair of legs is positioned at said second predetermined height enabling play by one player said barrier is positioned in front of said second goal area thereby preventing a ball disposed on the playing surface from entering said second goal area through said opening between said second flippers, whereby a ball disposed on said playing surface is allowable to enter said first goal area through said opening between said first flippers, and said at least one barrier arrangeable into a second position allowing a ball disposed on the playing surface to enter said second goal area through said opening between said second flippers when said pair of legs is positioned at said first predetermined height enabling play by two players.

2. The pinball game according to claim 1, wherein in said pair of legs includes at least a third predetermined height such that when said pair of legs is positioned at said at least third predetermined height the pinball game is oriented to be played by one player.

3. The pinball game according to claim 1, further comprising a first scoring system to be employed when said pair of legs is positioned at said first predetermined height and a second scoring system to be employed when said pair of legs is positioned at said second predetermined height.

4. The pinball game according to claim 3, further comprising a ball, a plurality of ball-engaging mechanisms, a first goal positioned adjacent a first player and a second goal positioned adjacent a second player, wherein when the first scoring system is being employed points are continually tallied as said ball engages said plurality of ball-engaging mechanisms, wherein if said ball enters said first goal said second player is awarded said points and if said ball enters said second goal said first player is awarded said points.

5. The pinball game according to claim 1, wherein said pair of legs includes a first leg and a second leg, each of said legs including a first extension and a second extension telescopically connected.

6. A pinball game comprising:

a ball;

a playing surface for playing a one-player game and a two-player game, said playing surface including a plurality of point awarding mechanisms such that when said ball engages said point awarding mechanisms points are accrued;

a frame for housing said ball and said playing surface;

a first goal area associated with said playing surface;

a second goal area associated with said playing surface;

a pair of spaced apart first flippers positioned on said playing surface in front of said first goal area, said first flippers providing an opening therebetween to allow access to said first goal area by a ball disposed on said playing surface;

a pair of spaced apart second flippers positioned on said playing surface in front of said second goal area said second flippers providing an opening therebetween to allow access to said second goal area by a ball disposed on said playing surface;

means for converting said playing surface from a one-player game to a two-player game, wherein said playing surface is horizontally oriented by said means to enable play by two players and said playing surface is incline oriented by said means to enable play by a single player; and at least one barrier arrangeable into a first position extending upwardly from said playing surface blocking only said opening between said second flippers to prevent access to said second goal area, such that when said playing surface is incline oriented by said means enabling play by one player said barrier is positioned in front of said second goal area thereby preventing a ball disposed on the playing surface from entering said second goal area through said opening between said second flippers, whereby a ball disposed on said playing surface is allowable to enter said first goal area through said opening between said first flippers, and said at least one barrier arrangeable into a second position recessed from said playing surface thereby allowing a ball disposed on the playing surface to enter said second goal area through said opening between said second flippers when said playing surface is horizontally oriented by said means enabling play by two players.

7. The pinball game according to claim 6, further comprising a first goal associated with a first player and a second goal associated with a second player, wherein during the two-player game said first player or said second player is awarded the accrued points by said ball entering said first or second goal associated with the other player.

8. The pinball game according to claim 6, wherein said means includes a pair of legs attached to said frame, said pair of legs having a first predetermined height and a second predetermined height such that when said pair of legs is positioned at said first predetermined height said playing surface is oriented to play a two-player game and when said pair of legs is positioned at said second predetermined height said playing surface is oriented a play a one-player game.

9. The pinball game according to claim 6, further comprising a first scoring system associated with the one player orientation of the game and a second scoring system associated with the two-player orientation of the game.

10. A pinball game adapted for play by either one or two players:

a playing surface having first and second ends, said playing surface adapted for supporting a pinball between said ends;

a first goal area associated with the first end;

a second goal area associated with the second end;

a pair of spaced apart first flippers positioned on said playing surface in front of said first goal area, said first flippers providing an opening therebetween to allow access to said first goal area by a ball disposed on said playing surface;

a pair of spaced apart second flippers positioned on said playing surface in front of said second goal area, said second flippers providing an opening therebetween to allow access to said second goal area by a ball disposed on said playing surface;

a tilting assembly associated with said playing surface for orientating said playing surface between a substantially horizontal position and an inclined position directed towards one of said first and second ends, wherein said pinball game is adapted as a one player game when said playing surface is in said inclined position and as a two player game when said playing surface is in said substantially horizontal position; and at least one barrier arrangeable into a first position extending upwardly from said playing surface blocking only said opening between said second flippers to prevent access to said second goal area thereby preventing a ball disposed on said playing surface from entering said second goal through said opening between said second flippers area when said playing surface is oriented in an inclined position during one-player game play, whereby a ball disposed on said playing surface is allowable to enter said first goal area through said opening between said first flippers, and said at least one barrier arrangeable into a second position recessed from said playing surface thereby allowing a ball disposed on the playing surface when oriented in a substantially horizontal position to enter said second goal area through said opening between said second flippers during two-player game play.

11. The pinball game according to claim 10, further including a point tallying system that tallies total accumulated points in response to a ball engaging a point scoring mechanism caused by either the first player or the second player during two-player game play, wherein during two-player game play either the first player is awarded the total accumulated points tallied in the point tallying system by both the first and second players if the ball enters the second goal or the second player is awarded the total accumulated points tallied into the point tallying system by both the first and second players if the ball enters the first goal.

12. The pinball game according to claim 1, where said barrier is recessed with the playing surface when in said second position.

* * * * *